United States Patent [19]

Weinberg et al.

[11] Patent Number: 4,534,854

[45] Date of Patent: Aug. 13, 1985

[54] DELAYED COKING WITH SOLVENT SEPARATION OF RECYCLE OIL

[75] Inventors: Harold N. Weinberg, Livingston; David W. Savage, Lebanon; Walter Weissman, Berkeley Heights, all of N.J.

[73] Assignee: Exxon Research and Engineering Co., Florham Park, N.J.

[21] Appl. No.: 523,962

[22] Filed: Aug. 17, 1983

[51] Int. Cl.[3] ..... C10G 9/14

[52] U.S. Cl. ..... 208/131; 208/86

[58] Field of Search ..... 208/131, 86, 309

[56] References Cited

U.S. PATENT DOCUMENTS

| | | | |
|---|---|---|---|
| 2,222,060 | 11/1940 | Arverson | 208/86 X |
| 2,380,713 | 7/1945 | Wilson | 208/131 |
| 2,727,853 | 12/1955 | Hennig | 208/86 X |
| 2,777,802 | 1/1957 | Peet . | |
| 2,800,433 | 7/1957 | Read | 208/86 X |
| 2,901,413 | 8/1959 | Newchurch et al. | 208/86 X |
| 2,925,374 | 2/1960 | Gwin et al. | 208/86 |
| 2,943,995 | 7/1960 | Mertes . | |
| 3,108,061 | 10/1963 | Meier | 208/309 |
| 3,172,840 | 3/1965 | Paterson . | |
| 3,247,095 | 4/1966 | Conwell . | |
| 3,563,884 | 2/1971 | Bloomer et al. | 208/131 X |
| 3,956,101 | 5/1976 | Hara et al. | 208/131 X |
| 4,057,487 | 11/1977 | Metrailer et al. . | |
| 4,066,532 | 1/1978 | Garcia | 208/131 X |
| 4,108,798 | 8/1978 | Sze et al. | 208/131 X |
| 4,216,074 | 8/1980 | Simone | 208/131 X |

*Primary Examiner*—D. E. Gantz
*Assistant Examiner*—Glenn A. Caldarola
*Attorney, Agent, or Firm*—Marthe L. Gibbons

[57] ABSTRACT

A delayed coking process is provided in which the fresh oil is introduced into the coker product fractionator and in which a stream of heavy oil product is withdrawn from the fractionator before it can contact the fresh oil. The stream of heavy oil product withdrawn from the fractionator is subjected to solvent separation to produce a high Conradson carbon product and a low Conradson carbon product. At least a portion of the low Conradson carbon product is recovered and the high Conradson carbon product is recycled to the coking zone.

8 Claims, 1 Drawing Figure

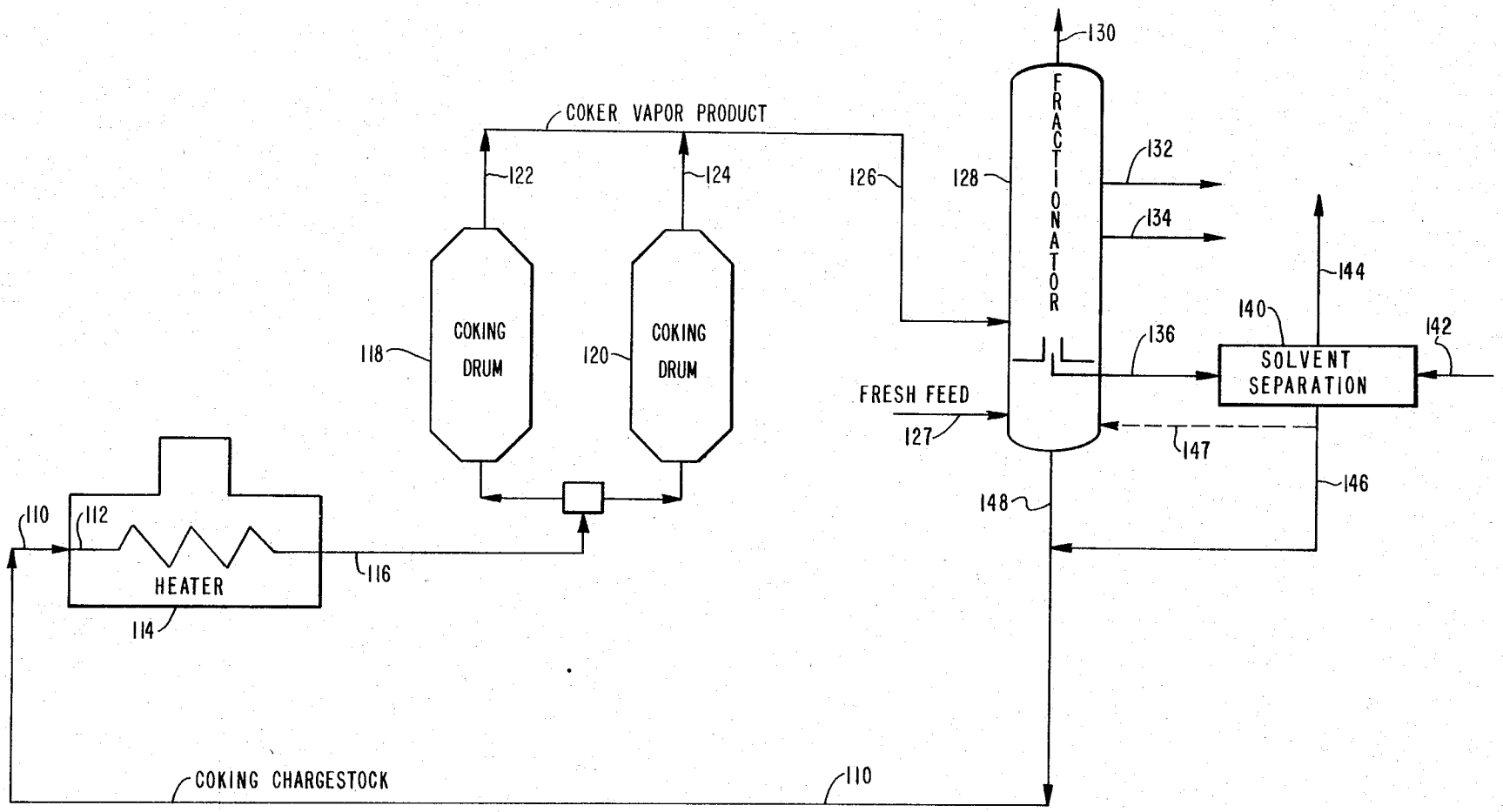
142
SOLVENT SEPARATION
144
146
140
147
132
134
136
130
FRACTIONATOR
128
148
FRESH FEED
127
126
110
COKER VAPOR PRODUCT
124
COKING DRUM
120
122
COKING DRUM
118
116
HEATER
114
112
110
COKING CHARGESTOCK

DELAYED COKING WITH SOLVENT SEPARATION OF RECYCLE OIL

BACKGROUND OF THE INVENTION

1. Field of the Invention

The present invention relates to an improvement in a delayed coking process.

2. Description of the Prior Art

Delayed coking is a well-known process in which a hydrocarbonaceous oil is heated to a coking temperature and then passed into a coking drum to produce a vapor phase product, including normally liquid hydrocarbons and coke. The drum is decoked by hydraulic means or by mechanical means. In some configurations of the delayed coking process, the fresh hydrocarbonaceous coker feed is introduced into the coker product fractionator, usually for heat exchange purposes, where it combines with the heavy coker products that are recycled to the coker heater. See *Hydrocarbon Processing,* September 1980, page 153.

The delayed coking process is generally conducted at a temperature ranging from about 800° to about 950° F. Typically delayed coking is conducted at a temperature above about 900° F.

U.S. Pat. No. 4,057,487 discloses a fluid coking process in which the heavy oil stream separated from the coker products in a scrubbing zone is passed to a vacuum distillation zone and a vacuum distillation zone bottoms fraction is recycled to the coking zone. Although such a scheme decreases the amount of lighter materials of the scrubber bottoms that needs to be recycled to the coking zone, there still remains a significant amount of relatively low Conradson carbon content constituents in the recycle stream.

U.S. Pat. No. 2,777,802 discloses, in FIG. 2, a fluid coking process in which the total coker overhead product is subjected to extractive distillation to remove metal contaminants. A bottoms product from the extractive distillation zone may be recycled to the coking zone.

U.S. Pat. No. 2,943,995 discloses a two-stage coking process in which a gas oil fraction separated from the first coking stage product is extracted with a solvent selective for aromatics, and the extracted aromatics are coked in the second coking stage.

U.S. Pat. No. 3,247,095 discloses coking a reduced crude and recycling fractionator bottoms to the coker. As shown in FIGS. I and II, a coker gas oil is withdrawn and solvent extracted. The extract is stripped and the stripped extract is recovered.

U.S. Pat. No. 3,172,840 discloses a delayed coking process in which the effluent in FIG. I is fractionated. A gas oil side-stream from the tower is thermally cracked and recycled to the coke drums.

It has now been found that withdrawing a portion of heavy hydrocarbons from the coker product fractionator before it can mix with the fresh oil feed that is being introduced into the fractionator, subjecting the withdrawn portion of heavy hydrocarbons to solvent separation, recovering at least a portion of the lower Conradson carbon product, and recycling the high Conradson carbon product to the coking zone will produce advantages that will become apparent in the ensuing description.

SUMMARY OF THE INVENTION

In accordance with the invention, there is provided a delayed coking process which comprises the steps of:

(a) preheating a hydrocarbonaceous oil charge-stock to a coking temperature;

(b) introducing the resulting preheated oil chargestock into a coking zone at delayed coking conditions to form coke and a vapor phase product, including light and heavy normally liquid hydrocarbons;

(c) separating at least a portion of said heavy hydrocarbons from said vapor phase product in a separation zone wherein a fresh hydrocarbonaceous oil is introduced;

(d) removing at least a portion of said heavy hydrocarbons from said separation zone of a step (c) prior to said portion of heavy hydrocarbons being able to mix with said fresh oil;

(e) subsequently, contacting at least a portion of said separated heavy hydrocarbons with a solvent in a solvent separation zone at separation conditions to separate said heavy hydrocarbons into a high Conradson carbon hydrocarbonaceous product and a low Conradson carbon hydrocarbonaceous product;

(f) recycling at least a portion of said high Conradson carbon hydrocarbonaceous product to said preheating zone of step (a), and (g) passing at least a portion of said fresh hydrocarbonaceous oil from said separation zone of step (c) to said preheating zone of step (a).

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a combined coking chargestock, (including a fresh hydrocarbonaceous oil and a recycle product derived as will be described later) is passed by line 110 into coil 112 of coking heater 114.

The coking oil chargestock is preheated in heater 114 to a coking temperature ranging from about 775° to about 1000° F., preferably from about 875° to about 950° F. The maximum heater coil outlet temperature will generally be about 1000° F. The coil outlet pressure will range from about 10 to 200 psig, preferably from about 50 to about 100 psig. In preheater 114, the oil is partially vaporized and mildly cracked. The preheated oil (vapor-liquid mixture) is removed from heater 114 and passed by line 116 into one of two coking drums, 118 and 120, (i.e., delayed coking zone) connected to coking heater 114. When one drum is in use, the other drum is being decoked by mechanical or hydraulic means. The coking drum operates at a lower temperature than the heater coil outlet temperature since the coking reaction is endothermic. The pressure in the coking drums ranges from about 20 to about 60 psig. Cracking of the oil produces coke in the coking drum. The vapor phase overhead product of the coking drum, which includes light and heavy normally liquid hydrocarbons, is removed from the respective coking drums by lines 122 and 124 and passed by line 126 to a separation zone (e.g. fractional distillation zone), such as a fractionator 128, where the coker overhead vapor product is separated into fractions. A fresh hydrocarbonaceous oil coking feed is introduced into fractionator 128 by line 127.

Suitable fresh hydrocarbonaceous oil feeds for the coking process include heavy hydrocarbonaceous oils; whole and reduced petroleum crude oils, including heavy crude oils; petroleum atmospheric distillation bottoms; petroleum vacuum distillation bottoms; pitch; asphalt; bitumen; other heavy hydrocarbon residues; tar and oils; shale oil; liquid products derived from coal liquefaction processes, including coal liquefaction bottoms, and mixtures thereof. Typically, such feeds have a Conradson carbon content of at least about 5 weight percent, generally from about 5 to about 50 weight percent, preferably above about 7 weight percent (as to Conradson carbon residue, see ASTM Test D-189-65). These oils usually have a high metals content (vanadium, iron and nickel). The metals content may range up to 2000 wppm metal or more.

Gas is removed from the fractionator by line 130, a light fraction is removed by line 132 and an intermediate fraction is removed by line 134. Lighter constituents of the fresh feed amy be included in the distillate fractions. A bottoms fraction of the fractionator is removed by line 148. A heavier fraction is removed from fractionator 128 by line 136 before that fraction can mix with the fresh incoming oil feed. Various methods can be used to prevent the incoming fresh oil feed from mixing with the heavier fraction. One method of preventing the fresh feed from mixing with the heavier fraction is to remove stream 136 above the location of the fresh oil inlet into the fractionator. The stream of heavy hydrocarbons removed by line 136 may have an initial boiling point ranging from about 650° F. to about 920° F. The end boiling point of stream 136 may be, for example, up to about 1,200° F. Heavy sidestream 136 is passed to solvent separation zone 140 (i.e., the second separation zone).

The Conradson carbon content of heavy sidestream 136, which is passed to solvent separation zone 140, will generally range from about 3 to about 50 weight percent. A solvent is introduced into solvent separation zone 140 by line 142 to contact heavy sidestream 136 of the fractionator. The solvent may be any suitable solvent known to be useful for separating lower Conradson carbon materials from higher Conradson carbon materials. The solvents may be those used either for deasphalting or for extraction or a combination thereof. Suitable extraction solvents include $C_1$ to $C_5$ alcohols; ketones such as acetone; ethanolamine; N-methyl pyrrolidone; gamma butyrolactone, and mixtures thereof. Solvent extraction methods are well-known in the art and are described, for example, in the *Kirk-Othmer Encyclopedia of Chemical Technology,* Vol. 9, John Wiley & Sons, 1980, pages 672 to 721.

Suitable deasphalting solvents include $C_3$ to $C_{16}$ aliphatic hydrocarbons, preferably $C_3$ to $C_{10}$ aliphatic hydrocarbons, preferably $C_3$ to $C_{10}$ aliphatic hydrocarbons, more preferably $C_4$ to $C_{10}$ aliphatic hydrocarbons and mixtures thereof. Deasphalting methods utilizing solvents that precipitate asphaltenes are well-known and are described, for example, in Kalichevsky, *Petroleum Refining with Chemicals,* Elsevier Publishing Co., 1956, pages 388–396. Suitable volumetric ratios of solvent to bottoms fraction will generally range from about 0.5:1 to 10:1, preferably 1:1 to 4:1.

The solvent contacting step is conducted at conditions and for a time sufficient to separate the heavy sidestream of fractionator 128 into a high Conradson carbon content hydrocarbonaceous product stream and a lower Conradson carbon hydrocarbonaceous stream. The Conradson carbon content of the low Conradson carbon stream will be less than that of the heavy sidestream of the fractionator which is passed to the solvent separation zone. The Conradson carbon content of the high Conradson carbon stream will be greater than the Conradson carbon content of the heavy sidestream of the fractionator that is passed to the solvent separation zone. Suitable conditions for deasphalting, for example, with pentane include a temperature ranging from about 170° to about 400° F., a pressure ranging from 50 to 500 psig and a time period ranging from 5 minutes to 2 hours.

The low Conradson carbon content stream is removed from solvent separation zone 140 by line 144. If desired, the solvent may be separated from stream 144 which may be sent to a catalytic cracking process or other conversion or recovery processes. The high Conradson carbon stream is withdrawn from solvent separation zone 140 and passed by line 146 to line 148 which carries the bottoms of fractionator 128. The bottoms of the fractionator comprise the fresh oil feed (less any components that may have been distilled into the coker product distillate fractions) and may include some coker products. The combined fractionator bottoms of line 148 and high Conradson carbon stream 146 are passed by line 110 as coking chargestock to heater 114. The preheated coking chargestock is then passed to the coking zone (i.e., coking drum). The amount of high Conradson carbon stream (i.e., recycle stream) is not critical and will vary widely. If desired, steam may be introduced into bottom of fractionator to steam strip the bottoms and thereby minimize carrying distillable hydrocarbons into the coking preheating zone. If desired, a portion of the high Conradson carbon stream may be recycled to the fractionator 128 as shown by line 147.

The process of the present invention permits improved recovery of the low Conradson carbon materials and, thereby, decreases the amount of remaining materials to be recycled to the coking zone. Since the portion of coker products to be recycled to the coking zone is reduced, the process heat requirements will also be reduced.

All boiling points referred to herein are atmospheric pressure boiling points unless otherwise specified.

What is claimed is:

1. A delayed coking process which comprises the steps of:

(a) preheating a hydrocarbonaceous oil chargestock to a coking temperature;

(b) introducing the resulting preheated oil chargestock into a coking zone at delayed coking conditions to form coke and a vapor phase product, including light and heavy normally liquid hydrocarbons;

(c) separating at least a portion of said heavy hydrocarbons from said vapor phase product in a separation zone wherein a fresh hydrocarbonaceous oil is introduced, said separated heavy hydrocarbons having a Conradson carbon content ranging from about 3 to about 50 weight percent;

(d) removing at least a portion of said heavy hydrocarbons from said separation zone of step (c) as a sidestream above the location of the introduction of said fresh oil into said separation zone of step (c) to prevent said portion of heavy hydrocarbons from mixing with said fresh oil;

(e) subsequently contacting at least a portion of said separated hydrocarbons, said portion of separated hydrocarbons having a Conradson carbon content of about 3 to about 50 weight percent, with a solvent in a solvent separation zone at separation conditions to separated said heavy hydrocarbons into a high Conradson carbon hydrocarbonaceous product and a low Conradson carbon hydrocarbonaceous product;

(f) recycling at least a portion of said high Conradson carbon hydrocarbonaceous product from said separation zone to said preheating zone of step (a);

(g) passing at least a portion of said hydrocarbonaceous oil from said separation zone of step (c) to said pre-heating zone of step (a), and (h) recovering said low Conradson carbon hydrocarbonaceous product of step (e).

2. The process of claim 1 wherein said separation zone of step (c) is a fractional distillation zone.

3. The process of claim 1 wherein said portion of heavy hydrocarbons removed in step (d) has an initial boiling point ranging from about 650° F. to about 920° F.

4. The process of claim 1 wherein said solvent separation is a solvent extraction process.

5. The process of claim 1 wherein said solvent separation is a solvent deasphalting process.

6. The process of claim 1 wherein said fresh hydrocarbonaceous oil of step (c) has a Conradson carbon content of at least about 5 weight percent.

7. The process of claim 1 wherein said hydrocarbonaceous oil chargestock is preheated in step (a) to a temperature ranging from about 775° F. to about 1000° F.

8. The process of claim 1 wherein said coking zone of step (b) is a sole coking zone.

* * * * *